US005873705A

United States Patent [19]

Chen

[11] Patent Number: 5,873,705

[45] Date of Patent: Feb. 23, 1999

[54] TIRE PUMP

[76] Inventor: Chiang-Pei Chen, No. 2, Lane 296, Ming Sheng Road, Wu Feng Hsiang, Taichung Hsien, Taiwan

[21] Appl. No.: 861,309

[22] Filed: May 19, 1997

[51] Int. Cl.[6] ..... F04B 19/02

[52] U.S. Cl. ..... 417/259; 417/467; 417/469

[58] Field of Search ..... 417/259, 466, 417/467, 468, 469

[56] References Cited

U.S. PATENT DOCUMENTS 5,443,370 8/1995 Wang ..... 417/469

FOREIGN PATENT DOCUMENTS 56-577A 1/1981 Japan ..... 417/469

954-600-A 9/1982 U.S.S.R. ..... 417/466

*Primary Examiner*—Timothy Thorpe

*Assistant Examiner*—Cheryl J. Tyler

*Attorney, Agent, or Firm*—Charles E. Baxley, Esq.

[57] ABSTRACT

A tire pump includes a head portion with a tubular portion extending therefrom and a main passage is defined through the head portion and communicates with the tubular portion, a connecting member slidably mounted to the tubular portion and having at least one first passage defined therethrough, a first cylinder retractably mounted to the tubular portion and having one of two ends fixedly connected to the connecting member and a first member slidably received therein which is fixedly connected to a free end of the tubular portion and detachably connected to the connecting member by an actuating device and has a uni-directional valve disposed therein. At least one second cylinder is retractably mounted to the first cylinder and has a second member slidably received therein which has a uni-directional valve disposed therein and a portion fixedly received in the other end of the first cylinder. A third member is fixedly received in the second cylinder and has a uni-directional valve disposed thereto.

4 Claims, 7 Drawing Sheets

TIRE PUMP

BACKGROUND OF THE INVENTION

1. Field of the Invention

The present invention relates to a tire pump and, more particularly, to an improved tire pump having a head portion and at least two cylinders retractably connected to the head portion.

2. Brief Description of the Prior Art

Generally, a bicycle is equipped with a tire pump disposed to the downtube or the seattube thereof so as to inflate the tires when needed. This tire pump has a limited length and includes a piston and a cylinder to which a head portion is connected so that only a limited volume of pressured air enters into the tire in each stroke. Accordingly, a user has to take time to inflate a tire by operating the tire pump repeatedly. It is not allowed to have a cylinder with a large volume for the tire pump because such a tire pump may not be suitable to be disposed to the bicycle.

The present invention intends to provide an improved tire pump to mitigate and/or obviate the above-mentioned problems.

SUMMARY OF THE INVENTION

The present invention provides a tire pump which includes a head portion having a main passage defined therethrough and a tubular portion extending therefrom which communicates with the main passage, a connecting member slidably mounted to the tubular portion and having at least one first passage defined therethrough which communicates with a first cylinder retractably mounted to the tubular portion. The first cylinder has one of two ends fixedly connected to the connecting member and has a first member slidably received therein which is fixedly connected to a free end of the tubular portion and detachably connected to the connecting member by an actuating means. A uni-directional valve is disposed in the first member. At least one second cylinder is retractably mounted to the first cylinder and has a second member slidably received therein which has a uni-directional valve disposed therein and a portion fixedly received in the other end of the first cylinder. A third member is fixedly received in the second cylinder and has a uni-directional valve disposed thereto.

It is an object of the present invention to provide a tire pump has at least two cylinders retractably mounted to a head portion thereof.

It is another object of the present invention to provide a tire pump producing a higher pressurized air.

It is a further object of the present invention to provide a tire pump which occupies a small space.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
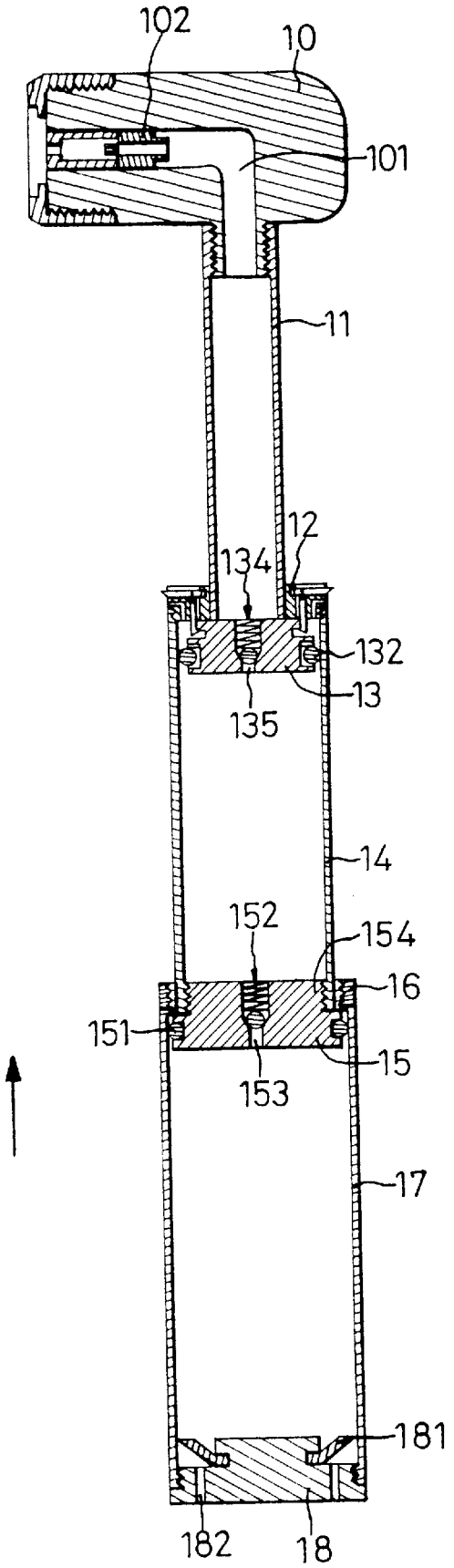
FIG. 1 is a side elevational view, partly in section, of a tire pump, when the two cylinders are extended, in accordance with the present invention.
Figure 2:
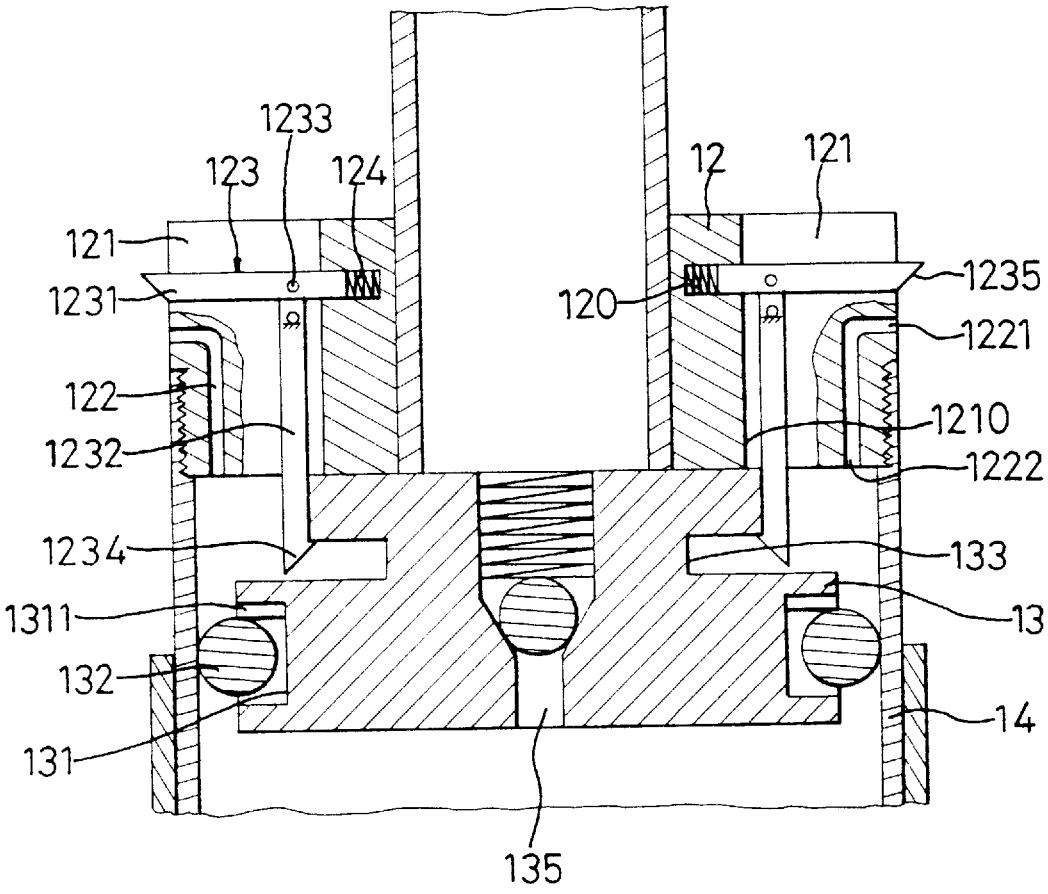
FIG. 2 is a side elevational view, partly in section and in an enlarged scale, of a connecting member mounted to the tubular portion of the head portion and an actuating means disposed in the connecting member.

Referring to the drawings and initially to FIGS. 1 and 2, a tire pump in accordance with the present invention generally includes a head portion 10 having a main passage 101 defined therethrough with an outlet valve 102 disposed in the main passage 101. The head portion 10 has a tubular portion 11 threadedly connected thereto which communicates with the main passage 101. A connecting member 12 is slidably mounted to the tubular portion 11 and has at least one first passage 122 defined therethrough which defines a first opening 1221 in a periphery of the connecting member 12 and a second opening 1222 in an under surface thereof.

A first cylinder 14 is retractably mounted to the tubular portion 11 and has a first member 13 slidably received therein which is fixedly connected to a free end of the tubular portion 11 and detachably connected to the connecting member 12 by an actuating means disposed in the connecting member 12. The first member 13 has a passage 135 defined therethrough in which a first uni-directional valve 134 is disposed which allows air in the first cylinder 14 to enter into the tubular portion 11. The first cylinder 14 has one of two ends thereof threadedly connected to the connecting member 12 and communicates with the first passage 122 via the second opening 1222.

The first member 13 has a first annular groove 131 and a second annular groove 133 respectively defined in an outer periphery thereof, a plurality of recesses 1311 defined in an upper and inner periphery defining the first annular groove 131 so as to allow a first seal ring 132 to be movably received in the first annular groove 131, that is to say, the first seal ring 132 has a diameter smaller than a height of the first annular groove 131. The connecting member 12 has a horizontal recess 121 and a vertical recess 1210 defined therein which communicates with the horizontal recess 121. The connecting member 12 has two concavities 120 respectively defined diametrically opposite in an outer periphery thereof and open to the horizontal recess 121. Each of the concavities 120 has a spring 124 received therein.

The actuating means 123 includes two horizontal rods 1231 each of which has one of two ends thereof inserted into the corresponding concavity 210 and urged by the spring 124 and is pivotally disposed to the connecting member 12 within the horizontal recess 121 at a first pivot point 1233. Two vertical rods 1232 are respectively and pivotally connected to the horizontal rods 1231 at the respective first pivot point 1233 and extend into the respective vertical recess 1210. Each of the vertical rods 1232 has a hook end 1234 so as to be engaged with the second annular recess 133 to limit the first cylinder 14 together with the connecting member 12 from being moved corresponding to the tubular portion 11. Each of the horizontal rods 1231 has an inclined surface 1235 defined in the other end, the free end, thereof which extends out from the connecting member 12.

A second cylinder 17 is retractably mounted to the first cylinder 14 and has a second member 15 slidably received therein. The second member 15 has a second seal ring 151 mounted thereto and a passage 153 defined therethrough in which a second uni-directional valve 152 disposed therein which allows air in the second cylinder 17 to enter into the first cylinder 14. The second member 15 has a portion 154 threadedly received in the other end of the first cylinder 14. A third member 18 is fixedly received in a free end of the second cylinder 17 and has a third uni-directional valve 184 disposed thereto which includes a flexible plate 181 mounted thereto within the second cylinder 17 and two second passages 182 are defined therethrough communicating with the second cylinder 17 so that air outside the pump is allowed to enter into the second cylinder 17 by deforming the flexible plate 181.

Figure 3:
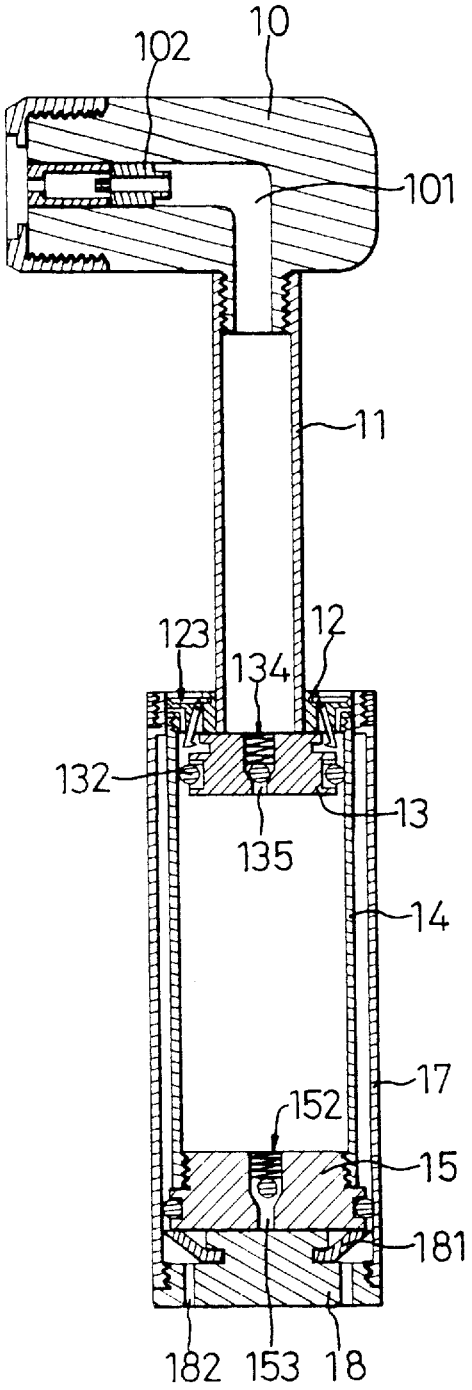
FIG. 3 is a side elevational view, partly in section, of the tire pump, when the second cylinder is pushed to receive the first cylinder therein.
Figure 4:
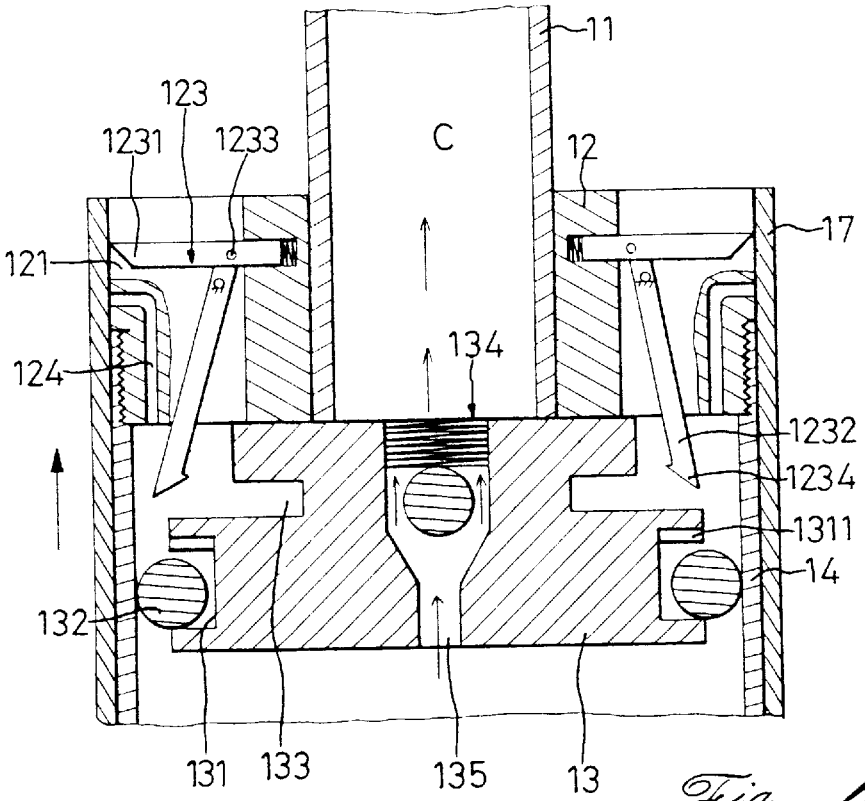
FIG. 4 is a side elevational view, partly in section and in an enlarged scale, of the actuating means which is actuated to disengage the connecting member from the first member.
Figure 5:
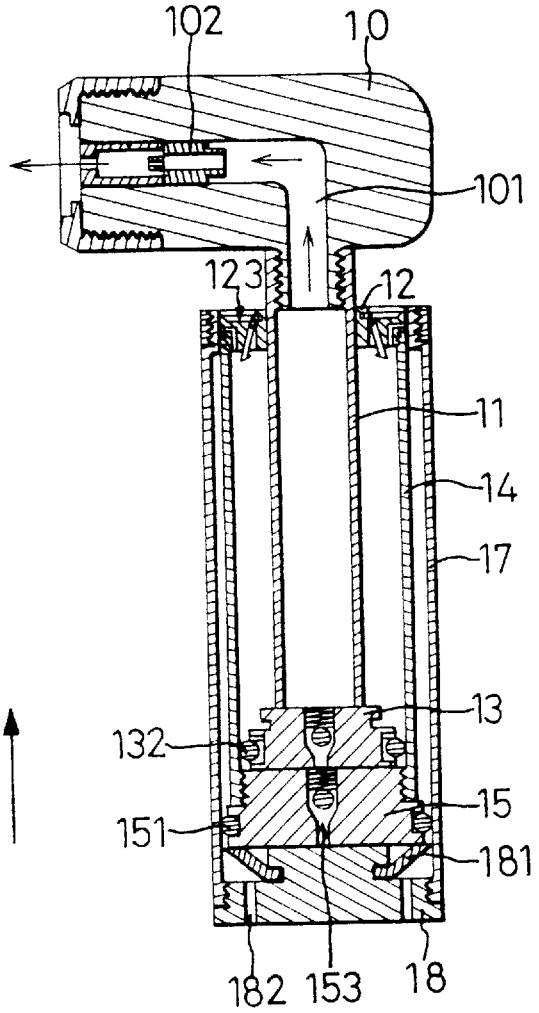
FIG. 5 is a side elevational view, partly in section, of the tire pump, when the two cylinders are pushed to let the tubular portion of the head portion be received in the first cylinder.

Referring to FIGS. 3 through 5, when operating the pump, a user (not shown) holds the second cylinder 17 and closes the second passages 182 to push the second cylinder 17 toward the first cylinder 14 so that air in the second cylinder 17 is forced into the first cylinder 14 via the second uni-directional valve 152 and the first cylinder 14 is received in the second cylinder 17 as shown in FIG. 3, wherein the two horizontal rods 1231 are retracted into the concavities 120 to push the springs 124 because the inclined surfaces 1235 contact the second cylinder 17 and the hook end 1234 of each of the vertical rods 1232 are disengaged from the second annular recess 133. The user then pushes both the first cylinder 14 and the second cylinder 17 toward the head portion 10, the connecting member 12 is then moved along the tubular portion 11 with the two cylinders 14, 17 to push air in the first cylinder 14 into the tubular portion 11 via the first uni-directional valve 134 as shown in FIG. 5 so as to inflate a tire.

Figure 7:
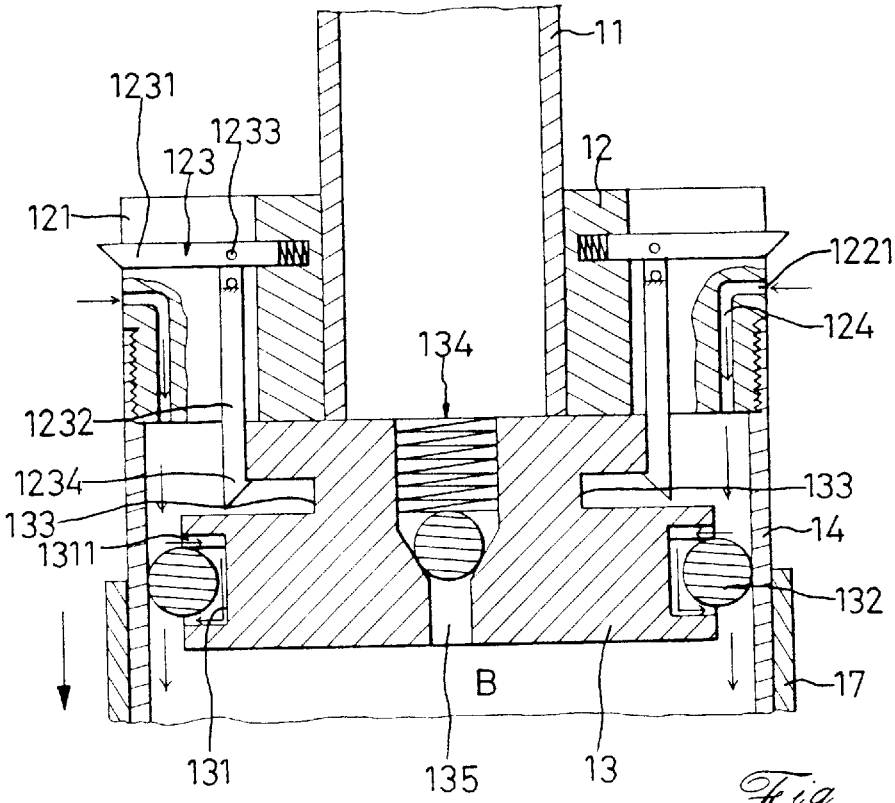
FIG. 7 is a view similar to FIG. 2 showing when the second cylinder is slightly pulled downwardly corresponding to the first cylinder, the actuating means connects the first member and the connecting member again.
Figure 6:
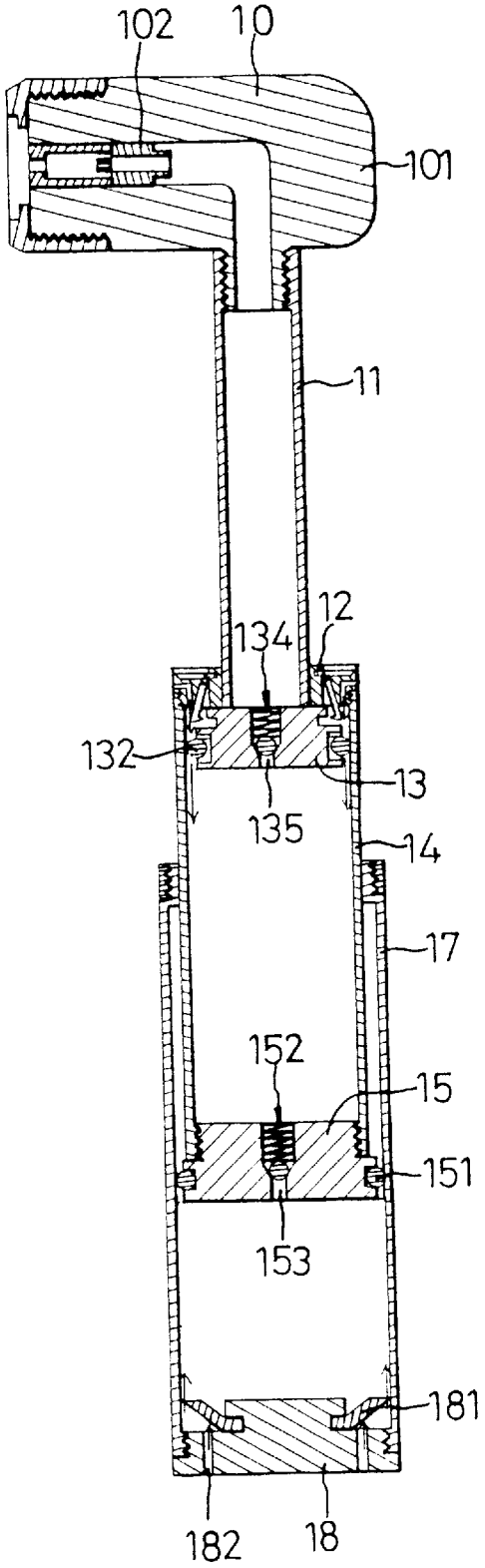
FIG. 6 is a side elevational view, partly in section, of the tire pump when the two cylinders are pulled downwardly corresponding to the tubular portion.
Figure 8:
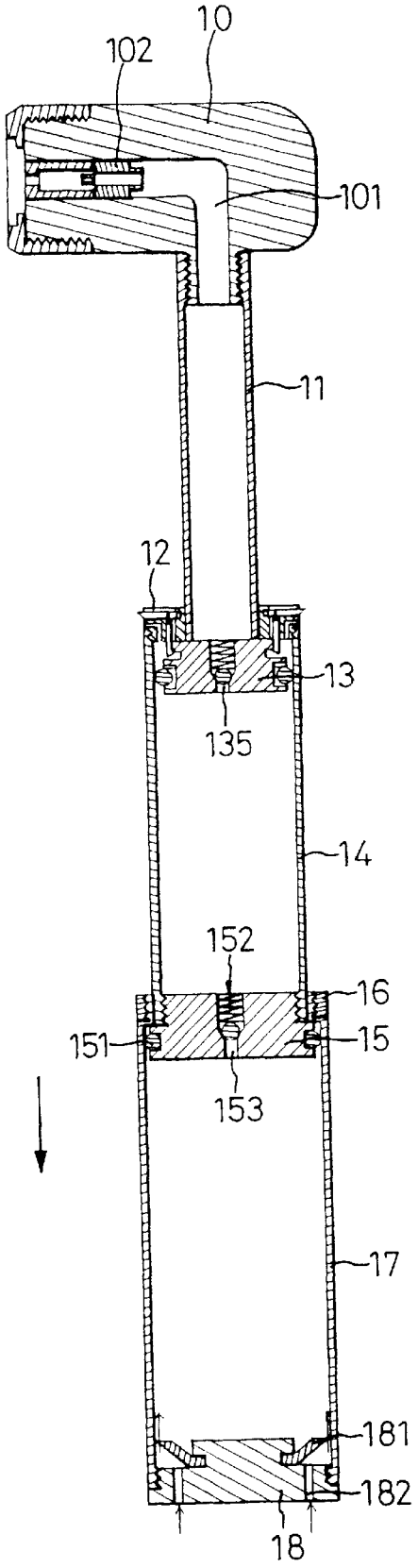
FIG. 8 is a view similar to FIG. 1 showing when the second cylinder is pulled downwardly corresponding to the first cylinder.

Referring to FIGS. 6 through 8, after the tubular portion 11 is received in the first cylinder 14, the user pulls the two cylinders 14, 17 downwardly and the second cylinder 17 is firstly pulled downwardly slightly so that the first opening 1221 is opened. Air will enter into the first cylinder 14 via the first passage 122 and flows into the first cylinder 14 via the recesses 1311 and the first annular recess 131 as shown by arrows in FIG. 7 to facilitate the first cylinder 14 to be pulled downwardly as shown in FIG. 6. At this moment, the hook ends 1234 of the vertical rods 1232 are engaged with the second annular recess 133 again so that the first cylinder 14 can not be moved downwardly any more. The user opens the second passages 182 and pulls the second cylinder 17 downwardly to let the pump be a status as shown in FIG. 8.

Accordingly, the pump occupies a small space when retracting the two cylinders 14, 17 and provides a high pressurized air which efficiently inflates a tire than conventional pump.

Although the invention has been explained in relation to its preferred embodiment, it is to be understood that many other possible modifications and variations can be made without departing from the spirit and scope of the invention as hereinafter claimed.

What is claimed is:

1. A tire pump comprising:

a head portion having a main passage defined therethrough with an outlet valve disposed in said main passage, said head portion having a tubular portion extending therefrom which communicates with said main passage, a connecting member slidably mounted to said tubular portion and having at least one first passage defined therethrough;

a first cylinder retractably mounted to said tubular portion and having a first member slidably received therein which is fixedly connected to a free end of said tubular portion and detachably connected to said connecting member by an actuating means disposed in said connecting member, said first member having a passage defined therethrough in which a first uni-directional valve is disposed which allows air in said first cylinder to enter into said tubular portion, said first cylinder having one of two ends thereof fixedly connected to said connecting member and communicating with said first passage;

at least one second cylinder retractably mounted to said first cylinder and having a second member slidably received therein, said second member having another passage defined therethrough in which a second uni-directional valve is disposed which allows air in said second cylinder to enter into said first cylinder, said second member having a portion fixedly received in the other end of said first cylinder, a third member fixedly received in said second cylinder and having a third uni-directional valve disposed thereto which allows air outside said pump to enter into said second cylinder.

2. The tire pump as claimed in claim 1 wherein said first member has a first annular groove and a second annular groove respectively defined in an outer periphery thereof, a plurality of recesses defined in an upper and inner periphery defining said first annular groove, a first seal ring is movably received in said first annular groove, said connecting member having a horizontal recess and a vertical recess defined therein which communicates with said horizontal recess, said connecting member having two concavities respectively defined diametrically opposite in an outer periphery thereof and opening to said horizontal recess, each of said concavities having a spring received therein, said actuating means including two horizontal rods each of which is inserted into said corresponding concavity and urged by said spring and is pivotally disposed to said connecting member within said horizontal recess at a first pivot point, two vertical rods respectively and pivotally connected to said horizontal rods at said respective first pivot point and extending into said respective vertical recesses, each of said vertical rods having a hook end so as to be engaged with said second annular recess, each of said horizontal rods having an inclined surface defined in a free end thereof which extends out from said connecting member so that when said first cylinder is retracted within second cylinder, said two horizontal rods are retracted to push said springs by said inclined surfaces contacting said second cylinder and said hook end of each of said vertical rods disengaged from said second annular recess.

3. The tire pump as claimed in claim 1 wherein said second member has a second seal ring mounted thereto.

4. The tire pump as claimed in claim 1 wherein said third uni-directional valve includes a flexible plate mounted thereto within said second cylinder and two second passages are defined therethrough communicating with said second cylinder.

* * * * *